US010480179B2

(12) United States Patent
Kennedy

(10) Patent No.: US 10,480,179 B2
(45) Date of Patent: Nov. 19, 2019

(54) PRE-FABRICATED DEFLECTION ABSORBENT MODULAR WALL SYSTEM

(71) Applicant: Mod Panel Manufacturing Ltd., Edmonton (CA)

(72) Inventor: David Kennedy, Edmonton (CA)

(73) Assignee: Mod Panel Technologies Ltd., Edmonton, Alberta (CA)

( * ) Notice: Subject to any disclaimer, the term of this patent is extended or adjusted under 35 U.S.C. 154(b) by 0 days.

(21) Appl. No.: 15/825,529

(22) Filed: Nov. 29, 2017

(65) Prior Publication Data

US 2019/0093338 A1 Mar. 28, 2019

(51) Int. Cl.

| | |
|---|---|
| ***E04F 13/08*** | (2006.01) |
| ***E04B 1/61*** | (2006.01) |
| ***E04B 1/98*** | (2006.01) |
| ***E04B 2/02*** | (2006.01) |
| ***E04B 2/58*** | (2006.01) |
| ***E04B 2/92*** | (2006.01) |

(52) U.S. Cl.

CPC ..... *E04B 1/61* (2013.01); *E04B 1/98* (2013.01); *E04B 2/02* (2013.01); *E04B 2/58* (2013.01); *E04B 2/92* (2013.01); *E04B 2001/6195* (2013.01); *E04B 2002/025* (2013.01); *E04B 2002/0276* (2013.01)

(58) Field of Classification Search

CPC ... E04F 13/076; E04F 13/077; E04F 13/0801; E04F 13/0803; E04F 13/0841; E04F 13/0875; E04F 13/0891; E04F 13/09

See application file for complete search history.

(56) References Cited

U.S. PATENT DOCUMENTS

| | | | | | |
|---|---|---|---|---|---|
| 4,361,993 | A * | 12/1982 | Simpson | E04B 1/14 | 52/222 |
| 4,472,916 | A * | 9/1984 | Krebs | E04B 1/18 | 52/236.6 |
| 4,472,920 | A * | 9/1984 | Simpson | E04B 1/14 | 52/222 |
| 4,602,468 | A * | 7/1986 | Simpson | E04C 3/08 | 52/222 |
| 4,628,650 | A * | 12/1986 | Parker | E04B 1/14 | 52/265 |
| 4,672,787 | A * | 6/1987 | Murphy | E04B 1/642 | 52/409 |
| 4,786,547 | A * | 11/1988 | St-Michel | B32B 21/02 | 428/215 |
| 5,470,178 | A * | 11/1995 | Weholt | E21D 11/38 | 405/150.1 |
| 6,076,320 | A * | 6/2000 | Butler | E02D 27/02 | 405/229 |

(Continued)

*Primary Examiner* — Gisele D Ford
(74) *Attorney, Agent, or Firm* — DLA Piper LLP (US)

(57) ABSTRACT

An L-bracket is provided to support manufacturered wall panels in a wall system. The L-bracket is attached to structural support members, such as floors, or hollow structural sections, so that any deflections in the floor system are accommodated in the wall panels. Each wall panel may be pre-fabricated to include shealthing, air/vapor barrier and insulation. Fasteners attach the shealthing of the wall panels to the L-bracket. Tape or strips may be applied between adjoining panels to provide a continuous air/vapor barrier for the wall system, and gaps in the insulation layer allows the air/vapor barrier to be sealed and inspected.

4 Claims, 7 Drawing Sheets

(56) References Cited

U.S. PATENT DOCUMENTS

| | | | | |
|---|---|---|---|---|
| 6,279,284 | B1 * | 8/2001 | Moras | E04B 1/10 52/105 |
| 9,010,050 | B2 * | 4/2015 | Hatzinikolas | B28B 19/0015 52/302.3 |
| 2013/0318911 | A1 * | 12/2013 | Sealock | E04F 13/08 52/747.1 |
| 2016/0208489 | A1 * | 7/2016 | Gibson | E04C 2/284 |

* cited by examiner

PRE-FABRICATED DEFLECTION ABSORBENT MODULAR WALL SYSTEM

CROSS-REFERENCE TO RELATED APPLICATIONS

This application claims priority to Canadian Patent Application No. 2,980,203, filed Sep. 26, 2017, the entire contents of which are incorporated by reference, as if fully set forth herein.

TECHNICAL FIELD

This disclosure relates to a modular wall system. In particular, it relates to a modular wall system that includes an air and vapour barrier that provides a barrier as a floor system deflects.

BACKGROUND

In structures, the floor system may deflect, or bend, as the building is constructed and when it is in use. It is preferable that the wall system is attached in a manner that may be attached to the floor and accommodate any deflection without damage, such as stressing the connection points, buckling or other damage.

Wall systems typically include sheathing, air and vapour barrier insulation and an exterior covering. Different materials from each of these layers has to be installed on the wall, typically made of studs. Floors, typically concrete or hollow structural sections (HSS), support the walls. Since there are often multiple floors, each with walls that need to be installed, wall systems that are easy and quick to assemble are desirable. The walls protect the interior of the space from the elements and allow other parts of the building construction to be done.

It is therefore desirable to provide a wall system that may be mounted to a structure that accommodates deflections in the floors and provides continuity of air/vapour barrier.

SUMMARY

The disclosure relates to a modular wall system that may be mounted to a structure in panels. The panels may have a deflection plate to which studs are attached that permits movement of the studs and panel without damaging the connection to adjoining panels. In addition, vapour barrier seams may be covered with sections of vapour barrier that allow relative movement between the panels.

BRIEF DESCRIPTION OF THE DRAWINGS

In drawings which illustrate by way of example only a preferred embodiment of the disclosure, FIG. 1 indicates a cross section of a wall system.

DETAILED DESCRIPTION

Figure 1:
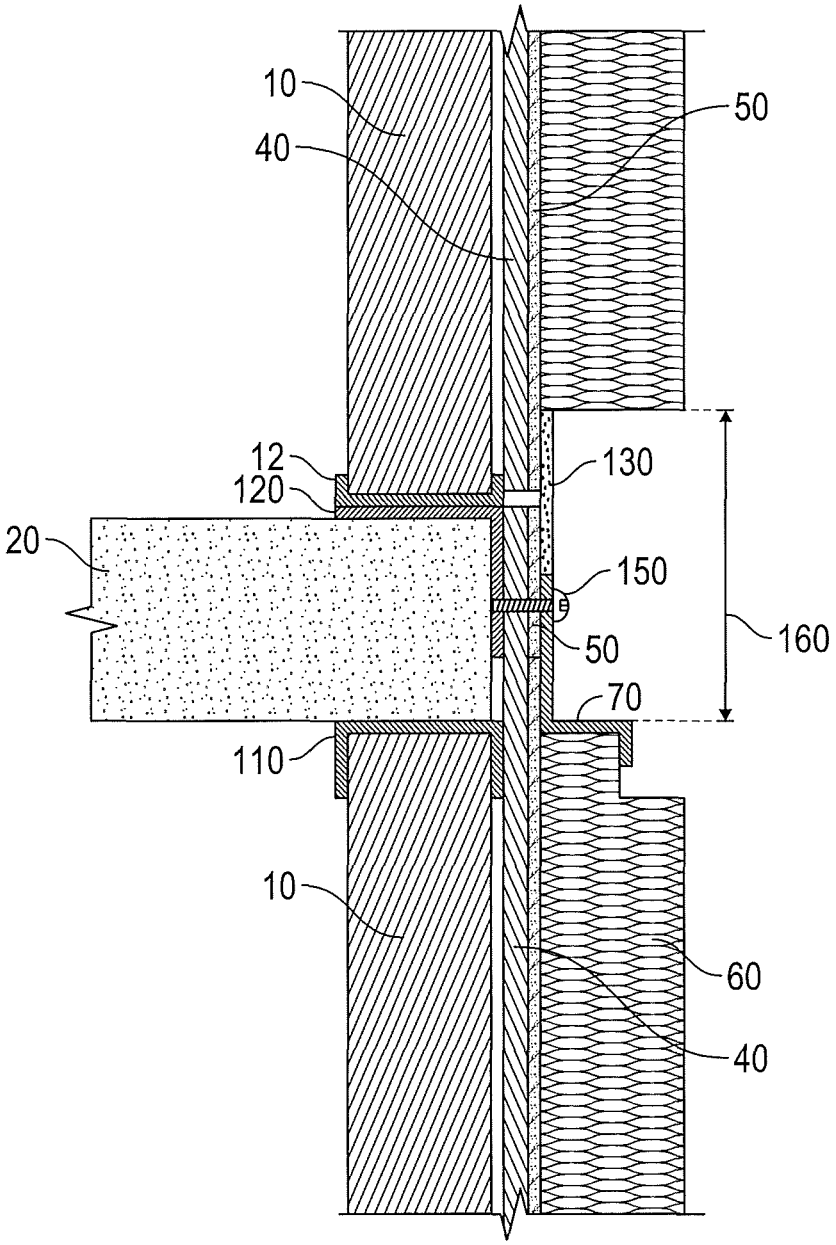
Figure 2:
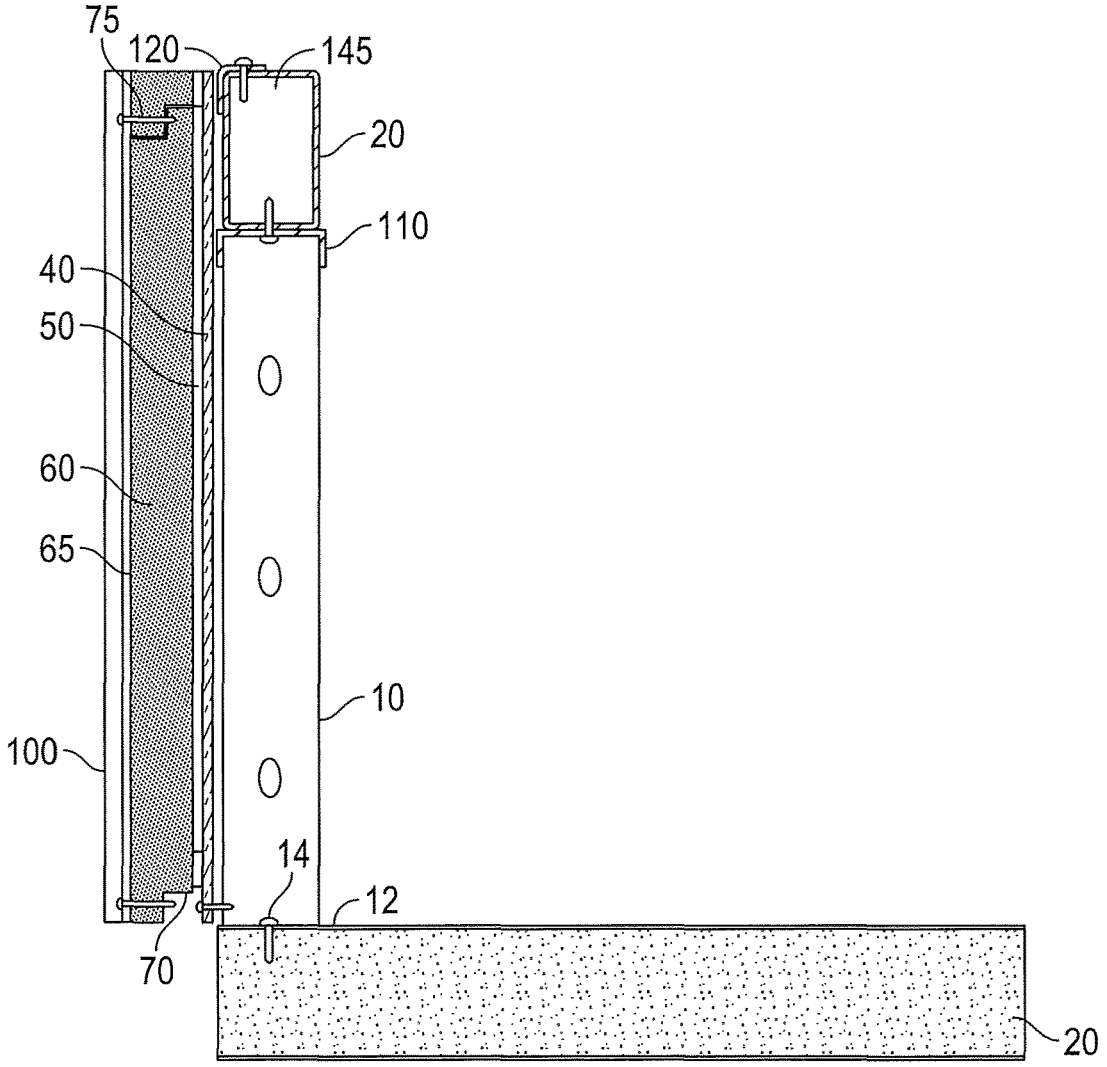
FIG. 2 indicates a cross section of a wall system.

In the wall system, modular panels are used to install a wall for a building. The panels may be prefabricated offsite.

Once floors are installed on a new building, the panels can be lifted into position and attached to the floors. The panels may include suitable openings for doors and windows. The panels may include the studs, stud tracks, and deflection tracks that are mounted to the floors. Since floors may sag or droop slightly due to load, the passage of time, air pressure changes, and other factors, the panels may accommodate slight changes in the vertical spacing between floors over time.

The panels may also include the sheathing 40 attached to the studs 10. The panels may also include air and vapour barrier (AVB) 50. Since it is preferred that the AVB provide a continuous barrier across multiple panels, the AVB of adjoining panels may be sealed after installation. Insulation, such as foam, may also be included as part of the panels. Exterior cladding support may also be included on the panels. Support brackets attach the cladding support to the structural support.

Each panel may include, the sheathing 40, the AVB 50, insulation 60 and support for exterior cladding 100.

In the panel wall system, a deflection system is included which provides for the vertical movement of adjoining floors. A deflection track 110 may be used to bridge the top of studs 10 in wall system construction. The deflection track 110 may comprise a u-track, with the flanges directed down and the web centred across the top of the studs 10 with vertical slots to in the flanges to allow mounting screws or bolts to slide, allowing for deflection movement.

The flanges, proximate to the interior and exterior surfaces of the studs, may have vertical slots to which the studs are attached, such as with screws. The vertical slots may allow some travel of the studs relative to the deflection track.

The web of the deflection track may also contain slots, preferably oriented parallel to the wall to allow lateral movement of the deflection track.

Sections of the deflection track may be attached together at splices. The splice may be a short section of u-track, preferably four inches, screwed into the vertical slots at each of the deflection tracks being joined together. The splice u-track may be mounted inverted as compared to the deflection track, with the opening of the u-track facing up.

With reference to FIG. 1, an "L" bracket 120 may be mounted to the floor support 20. The floor support may comprise structural steel support, such as hollow structural sections (HSS) components, having a substantially horizontal top surface. A first flange of the L-bracket may be layer on the substantially horizontal top surface of the floor support. One or more pins, or screws 145 may be used to fix the L-bracket 120 to the HSS 20.

The second flange of the L-bracket 120 is oriented on the exterior surface of the structure. The second flange may be oriented downward from the first flange, and parallel to the exterior surface of the HSS.

Figure 3:
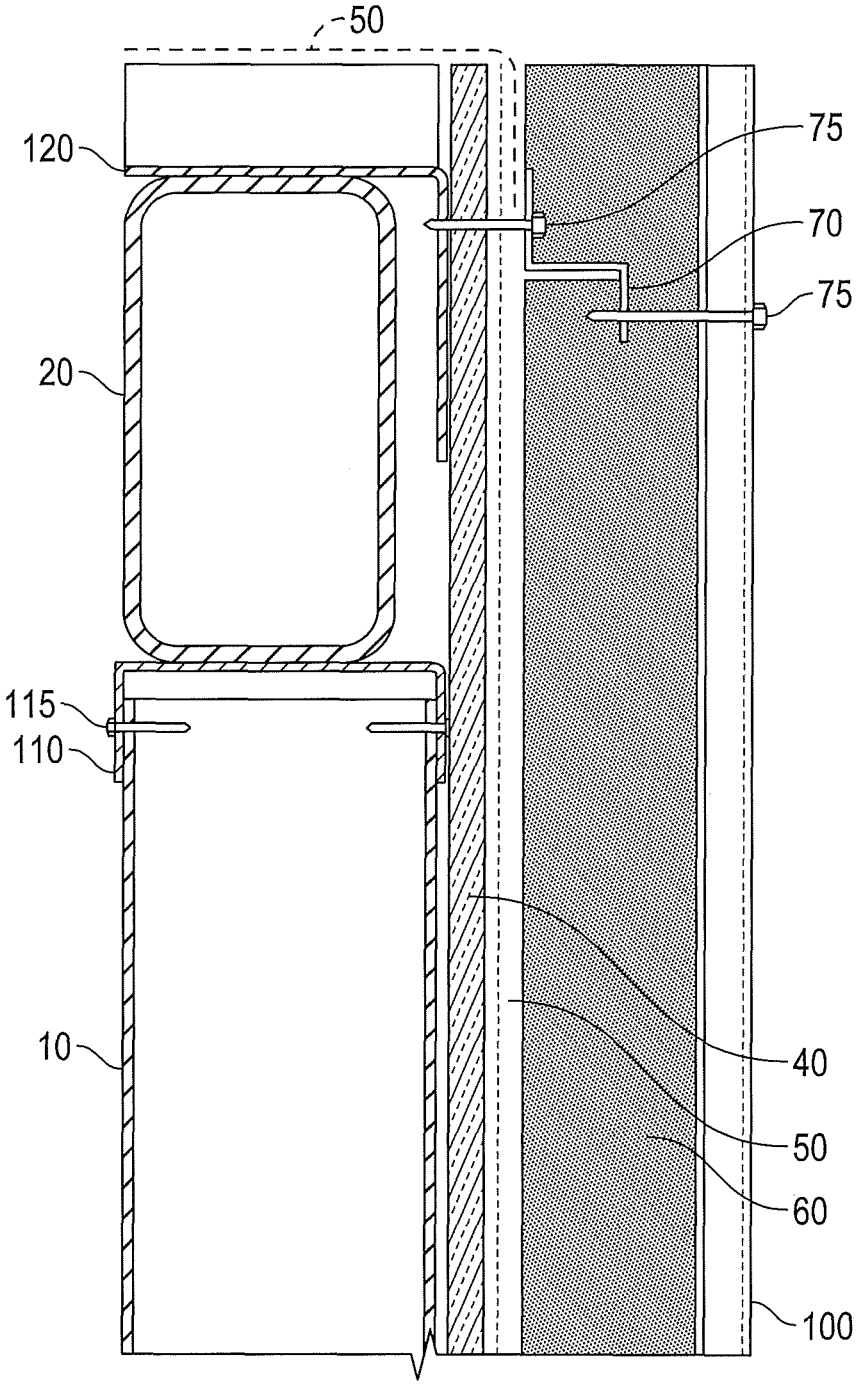
FIG. 3 indicates a cross section of a wall system at a window opening.

With reference to FIG. 3, an L-bracket 120 may also be used at window openings where a cross sill may be built into the wall. The first flange of the L-bracket may be layered on the cross sill and the second flange oriented down from the first flange.

The L-bracket 120 includes one or more mounting holes or slots for mounting an exterior wall system. Such a wall system may include panels constituting a modular wall system that include a plurality of L-brackets 120 across a top edge of each panel for attaching the panel to the floor system. The plurality of L-brackets may be spaced across the top edge of each panel on centre spacing similar to that of the stud 10 spacing.

The L-bracket 120 preferably is vertically slidably attached to the rest of the wall panel such that the L-bracket can move vertically relative to the rest of the wall panel. The slots in the L-Bracket may permit a fastener, such as a bolt or pin, to slide in the slot. This movement may allow the floor to move slightly, such as drooping, without damaging the wall panel.

The wall system may include panels that have a layer closest to the structure comprising a sheathing 40, such as manufactured by DensGlass®. On the outer surface of the sheathing there may be an air/vapour barrier (AVB) 50. The AVB 50 may have a minimum of holes in the barrier to reduce the movement of air and vapour across the barrier. A foam insulated layer 60 may be affixed to the AVB, sheathing and the panel to provide thermal and sound insulation.

In an embodiment, the foam layer 60 comprises at least two layers which have a lip at the edge of the panel. The lip may interlock with insulation on adjoining panels or with filler insulation placed between the panels. A z-bar 70 may engage with the foam layer to provide a mounting point for external hat tracks 100 on the exterior surface of the panel which may be used for mounting additional siding and exterior surfacing. The z-bar may also support the foam. Other layers may be fabricated as part of the panel including fire resistant panels such as those made of rock wool.

The panels may be pre-fabricated with the sheathing, AVB, foam and other external layers.

The pre-fabricated panels may be built off site and transported to a construction site. At the construction site, the panels may then be positioned on the structure and fastened to the structure. Lifting mounts may be included with the panels or attached to the panels to facilitate the panels being lifted into position for mounting on the structure.

The pre-fabricated panels may be mounted to the structure using the L-brackets 120 described above. In this way, the panels are fastened, using the L-brackets to the structural components of the structure.

The panel may include a mounting hole, with fasteners or pins 75 through the sheathing 40 that may be aligned with holes or slots in the L-bracket 120. The hole or pin may be attached to, or aligned with mounts in the z-bar 70. In this way the z-bar is fixed via the fastener 150 to the L-bracket and in turn, the floor 20.

Each panel may include a portion of the AVB 50 that protrudes beyond the end of the sheathing 40. The protruding AVB 50 may overlap or adjoin with AVB 50 of adjoining panels to provide a more continuous vapour barrier for the structure.

The foam layer 60 may be set-back or recessed from the edge of the panel such that a portion of the sheathing and AVB is visible at the edge of the panel on all sides. There may be a gap 160, such as of approximately 6 inches between the foam layer 60 of a panel and the foam layer 60 of an adjoining panel. The connection between the AVB 50 of one panel and the AVB 50 of an adjoining layer may be accessible and visible through this gap in the foam layer 60.

Where the AVB of one panel adjoins the AVB of a neighbouring panel, tape, strip 130 or other sealant may be applied to seal the connection. A strip of AVB that includes an adhesive surface may be applied to the seam. The strip 130 may include a cover on the adhesive surface that is removed prior to the strip being applied, such as peel and stick material.

During installation, the pre-fabricated panels may be mounted into position on the structure. Once in place, one or more AVB strips 130 may be applied to the seams between the panels to provide an additional barrier between the panels. The AVB strip 130 may be applied in the gap between the foam layers 60 of adjoining panels. Such a strip may be applied to each of the four sides of the panel.

Once the AVB strip 130 is applied and any inspections of the AVB 50 is completed, additional foam insulation layer 60 may be applied to fill in the gap. Since the gap between panels is defined when the panels are pre-fabricated, the additional foam may also pre-fabricated to an appropriate dimensions based on the size of the gap/recess to allow it to be installed quickly when the panels are installed. The additional insulation may be glued, or mechanically fastened, such as using fasteners that attach to the studs 10.

If the floor 20, studs 10 or other components deflect during construction or use, the pre-fabricated wall panels remain attached to the structural components. The deflection track 110 allows for the studs 10 to slide in the vertical mounting slots of the deflection tack 110.

Extra AVB that protrudes beyond the end of the sheathing 40 allows for some extra material if the distance between panels is extended due to floor movement. This extra material may be referred to as an expansion loop. In this way, the AVB is not damaged if there is floor movement.

Figure 4:
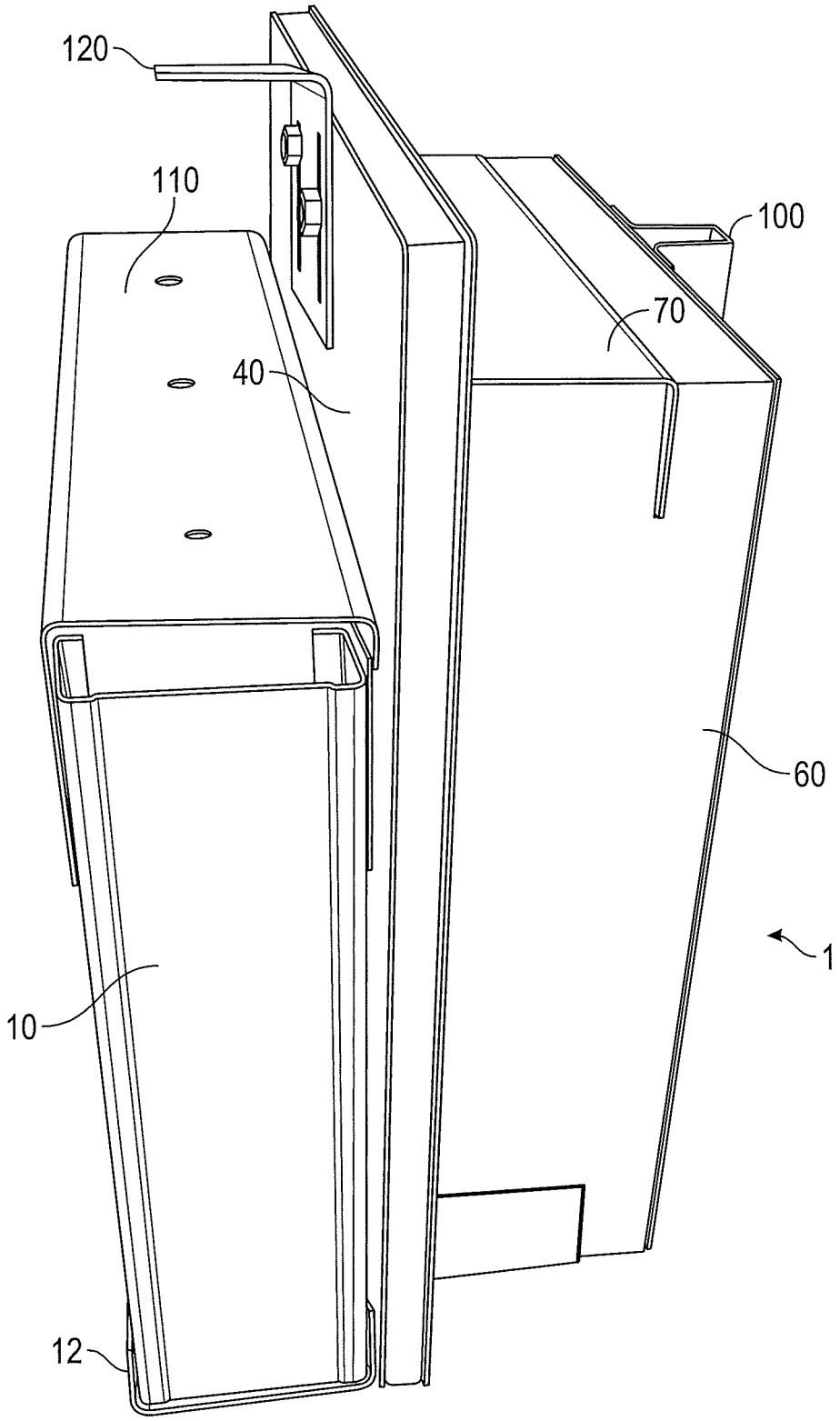
FIG. 4 indicates a perspective view of a wall panel.

With reference to FIG. 4, when pre-fabricated, wall panels may include L-brackets 120, a deflector track 110, studs 10, and stud track 12. The wall panel may also include sheathing 40 to which the L-brackets 120 are attached. AVB 50 may be attached to the sheathing and foam attached to the AVB using z-bar 70. The z-bars may be attached to the L-brackets using the same fastener 150. Hat tracks 100 may be attached to the z-bar 70. A plurality of z-bars and hat-tracks may be used to provide sufficient support for the panel. A larger panel will require additional substantially parallel z-bars and hat-tracks.

In addition to z-bars attached to the L-bracket, z-bars 70 may be attached to the studs 10 and provide additional support for the panel layers once mounted to the building structure. The z-bars, sheathing, studs and other components may be pre-fabricated in the panel.

At the building site, the wall panel 1 may be lifted into location and mounted to the floor 20. The floor may be positioned between the deflection track 110 and the L-brackets 120. Fasteners may be used to attach the L-brackets and deflection track 110 to the floor 20.

The wall panel 1 is fabricated to fit the dimensions of the floor 20 so that the distance between the flange of the L-bracket 120 and the deflection track 110 fits the height of the floor 20. The floor 20 may consist of a single floor element such as a concrete floor, or multiple elements such as a combination of concrete and HSS.

Figure 5:
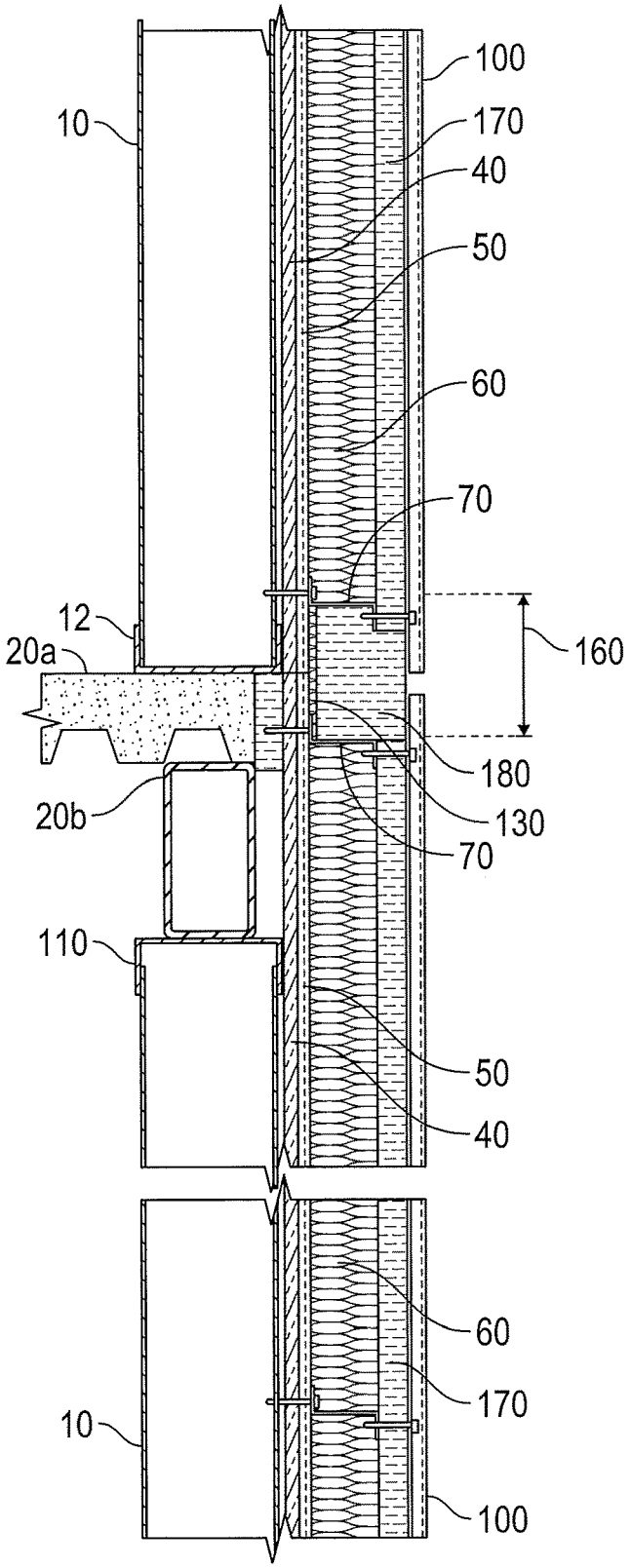
FIG. 5 indicates a cross section of a wall system.
Figure 6:
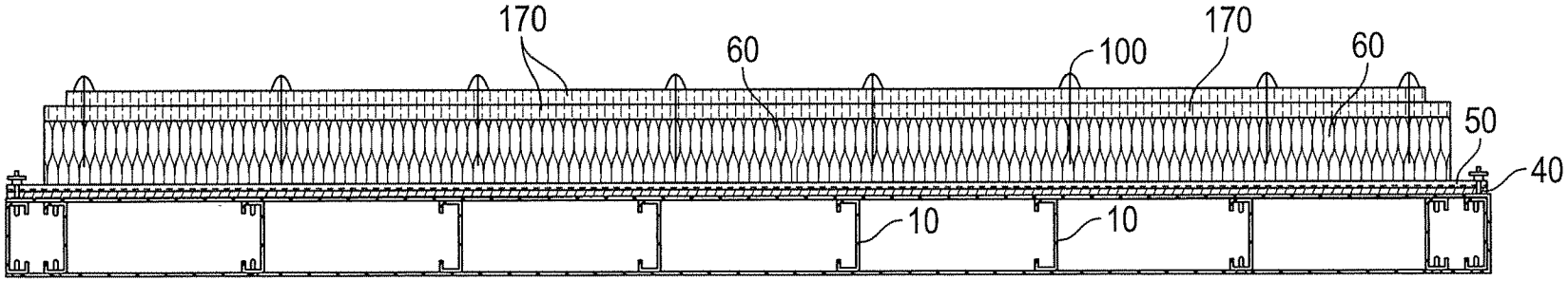
FIG. 6 indicates a cross section of a wall panel.

With reference to FIGS. 5 and 6, a wall system may include floor support 20 that comprises HSS floor support **20*a* and steel girts 20*b*. Although not shown in FIG. 5, an L-bracket attached to the panel may be attached to floor 20*a* under stud track 12. As described above, wall panels 1 may include a gap 160 in the foam layer 60 such that there is an approximately 6 inch wide gap in the insulation between adjoining panels. When the wall panels are installed, this gap may be filled with material 180**, such as insulation, foam or other material.

Each wall panel may include additional exterior layers. Fire resistant panels 170 such as roxul comfortboard may be attached to the z-bar 70. Hat track 100 may be also attached to the z-bar 70 to the exterior of the wall panel 1. In this way, exterior cladding may be attached to the hat track 100.

Figure 7:
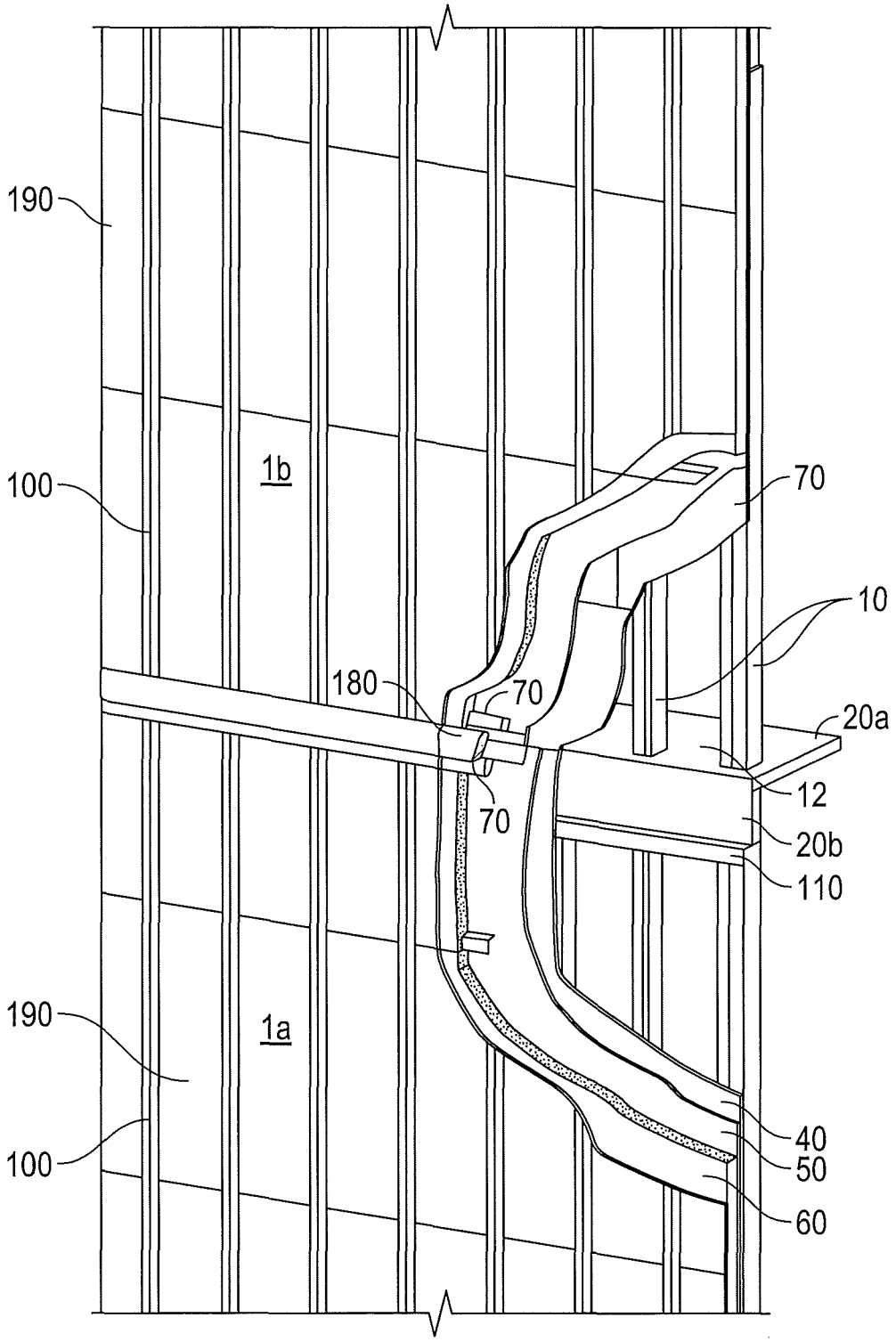
FIG. 7 is a cut away perspective view of a wall system.

With reference to FIG. 7, a portion of a wall system may include wall panels **1*a* and 1*b* from two floors adjoining. A wall panel 1*a* for a lower floor is affixed to the floor 20. The floor may include a concrete floor 20***a*, steel beam 20*b* or other structural steel support. A deflection track 110 is connected, as described above, to a plurality of studs 10. A wall panel 1*b* for an upper floor also has steel studs 10. The studs are connected to a stud track 12 if fixed to the floor 20. FIG. 7 only shows the lower edge of an upper wall panel 1*b* and the upper edge of the lower wall panel 1*a*.

Both wall panels 1*a* and 1*b*, may have sheathing 40, such as from Densglass, and air/vapour barrier 50. Foam insulation 60 may also be fixed to the wall panels. Exterior layers such as a rain screen 190 may also be attached to the wall panels. Hat tracks 100 attached to the panels may allow for exterior cladding to be attached to the wall panels. Z-bars 70 fixed to the floor 20 and studs 10, may support the foam 60, and hat tracks 100 to provide support. Using hat tracks or z-bars to support the exterior layers may provide an air spacing between the front face of the insulation 60 and the back side of the cladding.

A gap between the wall panels may be filled with suitable material 180, such as insulation or fire resistant material. The fill material 180 may be applied after the AVB 50 is inspected and the joint between adjoining panels is sealed.

Various embodiments of the present disclosure having been thus described in detail by way of example, it will be apparent to those skilled in the art that variations and modifications may be made without departing from the disclosure. The disclosure includes all such variations and modifications as fall within the scope of the appended claims.

We claim:

1. A method of installing a wall system to a structure, comprising:

mounting two or more wall panels, each comprising sheathing, a vapour barrier, and insulation, to the structure, the mounting comprising:

attaching one or more L-brackets fixed to each wall panel to a top surface of a floor, the one or more L-brackets fixed to each wall panel using one or more vertically oriented slots through which a fastener passes, allowing the L-bracket to move vertically relative to the rest of the wall panel, and mounting the two or more panels such that at least two of the panels adjoin;

sealing a seam between a vapour barrier of a first wall panel of the two or more wall panels, and a vapour barrier of a second wall adjoining the first wall panel; and installing a filler over the sealed seam between the first wall panel and the second wall panel.

2. The method of claim 1, wherein sealing the seam comprises applying an adhesive strip to the seam.

3. The method of claim 1, wherein the two or more wall panels are prefabricated with the insulation fixed to the one or more L-brackets and studs by at least one z-bar, the at least one z-bar having a first flange fixed to the one or more L-brackets, and a second flange fixed to the insulation.

4. The method of claim 3, wherein the two or more wall panels further comprise a cladding mounting track fixed to the at least one z-bar.

* * * * *